US008087666B2

(12) United States Patent
Honda et al.

(10) Patent No.: US 8,087,666 B2
(45) Date of Patent: Jan. 3, 2012

(54) SHEET DISCHARGE DEVICE AND IMAGE FORMING APPARATUS

(75) Inventors: Haruyuki Honda, Osaka (JP); Hiroshi Fujiwara, Osaka (JP); Kazuyoshi Kondo, Osaka (JP); Toshikane Nishii, Osaka (JP); Mizuna Tanaka, Osaka (JP); Tomoyoshi Yamazaki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 121 days.

(21) Appl. No.: 12/453,864

(22) Filed: May 26, 2009

(65) Prior Publication Data

US 2009/0295061 A1 Dec. 3, 2009

(30) Foreign Application Priority Data

May 28, 2008 (JP) ..... 2008-139296
Sep. 2, 2008 (JP) ..... 2008-224605

(51) Int. Cl.
*B65H 31/26* (2006.01)

(52) U.S. Cl. ..... 271/220; 271/207

(58) Field of Classification Search ..... 271/207, 271/220, 224, 221
See application file for complete search history.

(56) References Cited

U.S. PATENT DOCUMENTS

| | | | | |
|---|---|---|---|---|
| 5,094,660 | A * | 3/1992 | Okuzawa | 493/320 |
| 7,270,324 | B2 * | 9/2007 | Ogata et al. | 271/220 |
| 7,607,659 | B2 * | 10/2009 | Fukatsu et al. | 271/220 |
| 7,766,324 | B2 * | 8/2010 | Tamura et al. | 271/213 |
| 7,810,805 | B2 * | 10/2010 | Suzuki | 271/207 |
| 2003/0160385 | A1 * | 8/2003 | Furusawa | 271/220 |
| 2004/0201165 | A1 * | 10/2004 | Kamiya et al. | 271/220 |
| 2004/0251608 | A1 * | 12/2004 | Saito et al. | 271/220 |
| 2006/0237900 | A1 * | 10/2006 | Sekiyama et al. | 271/220 |
| 2007/0063427 | A1 * | 3/2007 | Hong | 271/220 |
| 2007/0065201 | A1 | 3/2007 | Fujiwara et al. | |
| 2007/0108697 | A1 * | 5/2007 | Tamura et al. | 271/220 |
| 2008/0273908 | A1 | 11/2008 | Ohkubo et al. | |
| 2008/0284090 | A1 | 11/2008 | Honda et al. | |
| 2009/0189344 | A1 * | 7/2009 | Suzuki | 271/314 |
| 2009/0212495 | A1 * | 8/2009 | Okuno | 271/272 |
| 2010/0171256 | A1 * | 7/2010 | Ogata et al. | 270/58.02 |

FOREIGN PATENT DOCUMENTS

| | | |
|---|---|---|
| JP | 5-338899 | 12/1993 |
| JP | 11-079519 | 3/1999 |
| JP | 2000-026005 | 1/2000 |

(Continued)

OTHER PUBLICATIONS

An English language abstract of Japanese Publication No. JP 8-067392, published Mar. 12, 1996.
An English language abstract of Japanese Publication No. JP 2005-206310, published Aug. 4, 2005.

*Primary Examiner* — Kaitlin S Joerger
(74) *Attorney, Agent, or Firm* — Harness, Dickey & Pierce, PLC

(57) ABSTRACT

A sheet discharge device discharges a sheet to a sheet discharge tray. The sheet discharge device includes a rotary shaft, two inside drive rollers, two outside drive rollers, two inside driven rollers, two outside driven rollers, two end retainers, and two inside retainers. The drive rollers are rotatably attached to the rotary shaft. Each of the driven rollers opposes a corresponding one of the drive rollers to be driven by the drive roller. The end retainers and the inside retainers rotatably extend from the rotary shaft across a common tangent of the driven rollers and the drive rollers. The end retainers are longer than the inside rollers and constructed so as to rest on the stacked sheets.

18 Claims, 10 Drawing Sheets

FOREIGN PATENT DOCUMENTS

| | | |
|---|---|---|
| JP | 2001-270642 | 10/2001 |
| JP | 3323661 | 6/2002 |
| JP | 2002-249270 | 9/2002 |
| JP | 2002-284441 | 10/2002 |
| JP | 2006-151588 | 6/2006 |
| JP | 4116973 | 4/2008 |

* cited by examiner

SHEET DISCHARGE DEVICE AND IMAGE FORMING APPARATUS

CROSS-REFERENCE TO RELATED APPLICATIONS

The present application claims priority to and incorporates by reference the entire contents of Japanese priority document 2008-139296 filed in Japan on May 28, 2008 and Japanese priority document 2008-224605 filed in Japan on Sep. 2, 2008.

BACKGROUND OF THE INVENTION

1. Field of the Invention

The present invention relates to a technology for discharging a sheet of a recording medium in an image forming apparatus.

2. Description of the Related Art

In an image forming device, a paper sheet is passed through a nip between a pressure roller and a heating roller in a fixing device to fix a toner image onto the paper. However, the paper sheet can curl when it passes through the nip. More specifically, a leading end and a trailing end of the paper sheet in its conveying direction can curl upward (see FIG. 10) due to heat applied thereto and/or ambient temperature in the fixing device. If a paper sheet with a large upward curl is discharged onto a paper discharge tray (hereinafter, "tray") in which paper sheets are stacked, discharged paper sheets in the tray can be disrupted. More specifically, when the next paper sheet having undergone the fixing process is discharged into the tray that contains curled paper sheets by a discharge roller, the next paper sheet can push a trailing end of a stack of the paper sheets in the tray or enter through the stack to be beneath another paper sheet of the stack. As a result, some of the stacked paper sheets can be pushed out of the tray or the order of the paper sheets can be disrupted. To this end, a larger sheet discharge tray has been employed in some cases, while an additional movable sheet guide has been arranged near the discharge roller in other cases.

For example, Japanese Patent Application Laid-open No. H5-338899 discloses a technique that uses a movable sheet guide that is driven by a drive source such as a solenoid. When a leading edge of a paper sheet (hereinafter, "sheet") is discharged onto a sheet discharge tray, the sheet is discharged with its leading end lifted upward so that the sheet will not push the leading end of a stack of sheets already in the tray. In contrast, the sheet is discharged with its trailing end pushed downward so that the trailing end of the stack is lifted up and less easily pushed by the leading edge of the sheet.

However, the approach that uses a larger sheet discharge tray is disadvantageous in requiring a larger space for the tray. The other approach as disclosed in Japanese Patent Application Laid-open No. H5-338899 is disadvantageous in that the movable sheet guide requires an additional drive source, and an additional gear or a spring, as well as additional space for these components. From another point of view, it is possible to construct a sheet discharge device compact or less expensively if a larger tray or a movable sheet guide becomes unnecessary.

Japanese Patent Application Laid-open No. 2001-270642 discloses a technique that uses sheet members that retain a sheet being discharged and are arranged on both sides of a path of the sheet. The sheet members are arranged such that downstream ends of the sheet members in a sheet conveying direction are positioned downstream relative to a nip between a pair of discharge rollers through which the sheet is to be discharged. Accordingly, because curling of the sheet at the both sides is prevented, a trailing end of a stack of discharged sheets in a sheet discharge tray is prevented from being pushed by a leading edge of the sheet in the sheet conveying direction.

However, this approach is disadvantageous in that because the sheet members are long as compared to the sheet, the sheet can be bent while the sheet is discharged.

Japanese Patent Application Laid-open No. 2000-26005 discloses a sheet finisher that resiliently deforms, even when a sheet to be discharged is thin or thick, the sheet by an appropriate amount of deformation. To attain this, the sheet finisher includes a resilient deformation roller, an arm member that causes the resilient deformation roller to be swung, and a spring that urges the arm member. However, this approach is disadvantageous in requiring additional cost and space for the resilient deformation roller and the like.

Japanese Patent Application Laid-open No. 2002-284441 discloses a sheet discharge apparatus that determines whether a sheet being discharged is curled downward. The sheet discharge apparatus includes two spatulate feelers, a downward-curl detecting sensor, and a curled-sheet-full detecting plate. The spatulate fillers are arranged on a shaft different from a shaft on which sheet discharge rollers are arranged. Whether a sheet being discharged is curled downward is determined based on an output signal of the downward-curl detecting sensor. Whether a sheet discharge tray is full with curled sheets is determined by using the curled-sheet-full detecting plate. However, this approach is also disadvantageous in requiring additional space for these components.

Japanese Patent Application Laid-open No. H11-79519 discloses a technique that uses a sheet retainer that retains a sheet being discharged. The sheet retainer is fixed at one end to a frame, which is a support of the sheet retainer, while the sheet retainer is slidably attached to the frame at the other end. The sheet retainer has, between these ends, a bent portion that protrudes toward a sheet discharge tray and that is arranged near a sheet discharge surface of the tray. However, this approach is disadvantageous in requiring additional cost and space for arranging the frame that is independent from a shaft on which a sheet discharge roller is supported.

Japanese Patent Application Laid-open No. 2002-249270 discloses a technique that uses a sheet retainer arranged at a position where the sheet retainer does not contact a leading end portion of a sheet being discharged by a discharge roller but contacts a trailing end portion of a sheet having been discharged by a sheet discharge roller onto a sheet discharge tray.

Image forming apparatuses typically include a sheet discharge device that receives a printed sheet conveyed from a fixing device and discharges the sheet by using sheet discharge rollers onto a sheet discharge tray to stack the printed sheets in the tray. In such a sheet discharge device, a sheet that exits the sheet discharge rollers is typically resiliently deformed to adjust a position where the sheet is to be placed in the tray according to the shape of the tray. By this adjustment, sheets stacked in the tray can be aligned. This resilient deformation of the sheet is typically performed by using a portion of a shaft of a drive roller or a driven roller at which the diameter of the shaft is larger than that at a nip between the sheet discharge rollers. It is also typical that a delivery member is arranged near the discharge rollers. The delivery member comes into contact with a trailing edge of a sheet being discharged and forces the sheet to exit the discharge rollers, thereby preventing a trailing edge of the sheet from remaining near the discharge rollers. Hence, the sheet can be discharged onto the tray without fail. The delivery member has typically an uneven surface and a diameter that is larger than that of the nip.

When an amount of curl of a sheet being discharged is large, the sheet can push, at its leading edge, a stack of sheets in a sheet discharge tray, causing one or more of the sheets of the stack to be pushed out of the tray or disrupting the order of the sheets in the tray. To this end, a sheet retainer that presses a portion of the stack near its trailing against a sheet discharge tray is employed in some cases so that the leading edge of the sheet being discharged will not push one or more sheets of the stack out of a tray.

However, when the sheet retainer is arranged and a trailing end portion of a sheet being discharged is deformed downward, the sheet has a wavy profile in a sheet width direction. This wavy profile prevents the sheet from coming into full contact with the large-diameter portion. In this case, it is possible that the sheet is insufficiently deformed or fails to exit the discharge rollers.

Japanese Patent No. 3323661 discloses a technique for preventing a sheet being discharged from undesirably curling or pushing an already-discharged sheet by using a protrusion. This protrusion is arranged at a substantially center on a surface of a discharge pawl in a sheet width direction. The discharge pawl comes into sliding contact with a sheet being discharged. The sheet is resiliently deformed into a wavy profile while passing through the protrusion.

Japanese Patent No. 4116973 discloses an approach for reducing an amount of curl by using a sheet retaining mechanism even when a sheet being discharged onto an internal sheet-receiving tray has a large curl due to properties of material of the sheet or its moisture absorption.

SUMMARY OF THE INVENTION

It is an object of the present invention to at least partially solve the problems in the conventional technology.

According to an aspect of the present invention, there is provided a sheet discharge device that discharges a sheet of a recording medium on which an image has been formed to a sheet discharge tray. The sheet discharge device includes a rotary shaft that extends in a first direction and has a sheet conveyance center in the first direction; a drive roller group that includes at least two inside drive rollers rotatably arranged on the rotary shaft on either sides of the sheet conveyance center and at least two outside drive rollers rotatably arranged on the rotary shaft on either sides of the inside drive rollers; a driven roller group that includes at least two inside driven rollers and at least two outside driven rollers, the inside driven rollers individually opposing the inside drive rollers to be rotated by the inside drive rollers, the outside driven rollers individually opposing the outside drive rollers to be rotated by the outside drive rollers; at least two end retainers each of which is rotatably attached to the rotary shaft and positioned adjacent to one of the outside drive rollers from a side away from the sheet conveyance center, the end retainers coming into press contact with first near-side-end portions of the sheet being discharged to retain the sheet; and at least two inside retainers each of which is rotatably attached to the rotary shaft and adjacent to one of the inside drive rollers from a side away from the sheet conveyance center, the inside retainers coming into press contact with second near-side-end portions of the sheet being discharged to retain the sheet, each retainer of the end retainers and the inside retainers including a distal end on a side away from the rotary shaft. When the each retainer is in an unretracted orientation, the each retainer extends from the rotary shaft such that the distal end is further away from the rotary shaft than a common tangent of the drive roller group and the driven roller group is, and the end retainers are longer than the inside retainers and rest on a stack of sheets in the sheet discharge tray.

According to another aspect of the present invention, there is provided a sheet discharge device that discharges a sheet of a recording medium on which an image has been formed to a sheet discharge tray. The sheet discharge device includes a rotary shaft that extends in a first direction and has a sheet conveyance center in the first direction; a drive roller group that includes at least two inside drive rollers rotatably arranged on the rotary shaft on either sides of the sheet conveyance center and at least two outside drive rollers rotatably arranged on the rotary shaft; a driven roller group that includes at least two inside driven rollers and at least two outside driven rollers, the inside driven rollers individually opposing the inside drive rollers to be rotated by the inside drive rollers, the outside driven rollers individually opposing the outside drive rollers to be rotated by the outside drive rollers; at least two end retainers each of which is rotatably attached to the rotary shaft and positioned adjacent to one of the outside drive rollers from a side away from the sheet conveyance center, the end retainers coming into press contact with first near-side-end portions of the sheet being discharged to retain the sheet; at least two inside retainers each of which is rotatably attached to the rotary shaft and adjacent to one of the inside drive rollers from a side away from the sheet conveyance center, the inside retainers coming into press contact with second near-side-end portions of the sheet being discharged to retain the sheet; and at least one center retainer that is rotatably arranged on the rotary shaft and positioned between the inside drive rollers, the center retainer coming into press contact with a center portion of the sheet being discharged to retain the sheet, each retainer of the end retainers and the center retainer including a distal end on a side away from the rotary shaft. When the each retainer is in an unretracted orientation, the each retainer extends from the rotary shaft such that the distal end is further away from the rotary shaft than a common tangent of the drive roller group and the driven roller group is. Each of the inside driven rollers includes a nip portion where the inside driven roller contacts the inside drive roller and an inside portion where the inside driven roller does not contact the inside drive roller. The inside driven roller includes, on the inside portion, an expanded portion at which a diameter of the inside driven roller is larger than at the nip portion, and the end retainers are longer than the center retainer and rest on a stack of sheets in the sheet discharge tray.

According to still another aspect of the present invention, there is provided an image forming apparatus including a conveying unit that feeds and conveys a sheet of a recording medium; a transfer unit that transfers an image onto the sheet; a fixing unit that applies heat and pressure to the sheet to fix the transferred image onto the sheet; and the above sheet discharge device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
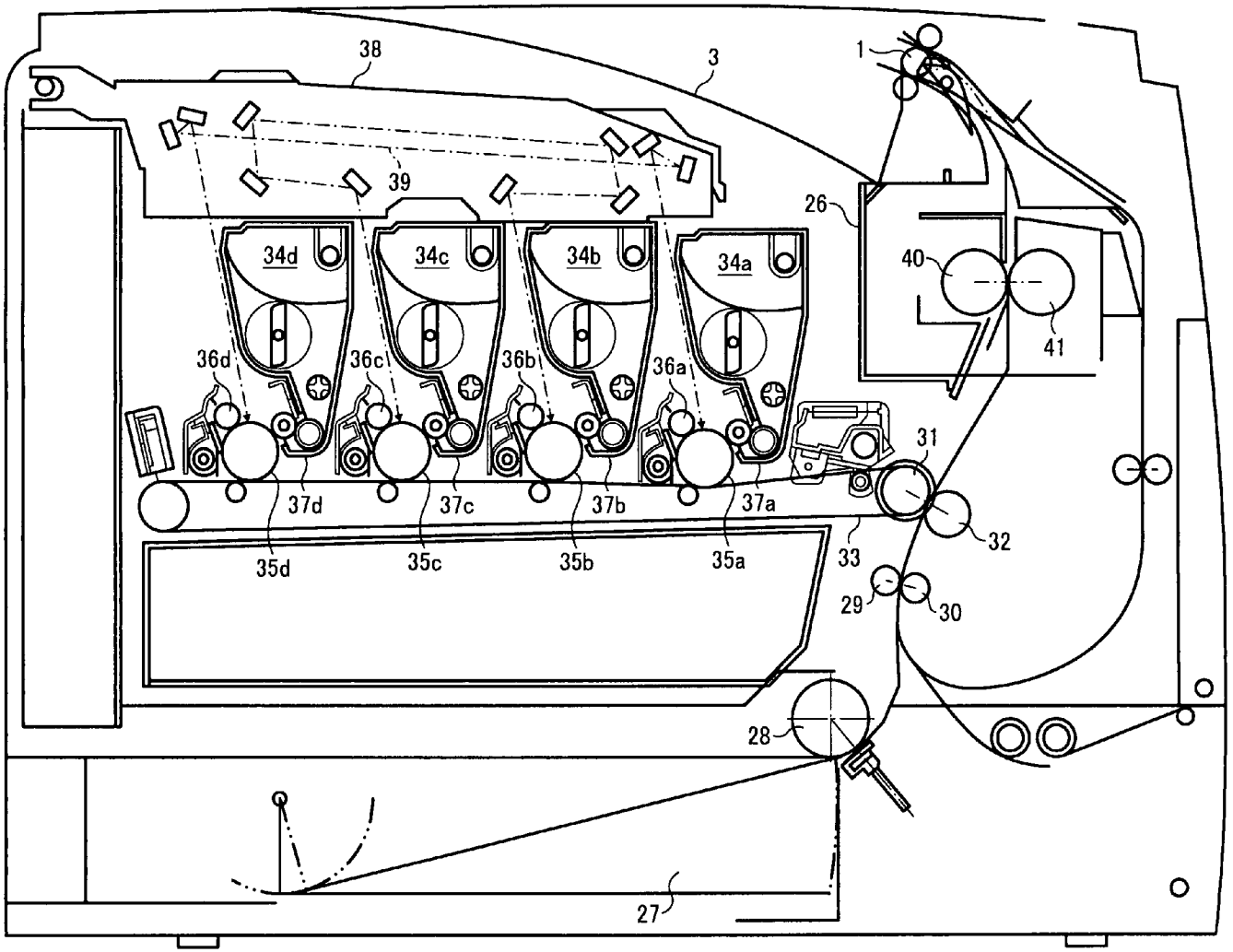
FIG. 1 is a schematic side view of an internal configuration of an image forming apparatus that includes a sheet discharge device according to a first embodiment of the present invention.

FIG. 1 is a schematic side view of an internal configuration of an image forming apparatus that includes a sheet discharge device 1 according to a first embodiment of the present invention. A sheet of a recording medium (hereinafter, "sheet") 4 is fed by a sheet feed roller 28 from a sheet cassette 27 to a pair of registration rollers 29 and 30 that in turn feed the sheet 4 to a pair of transfer drive roller 31 and a transfer driven roller 32. The transfer drive roller 31 is arranged inside an intermediate transfer belt 33 and rotates the intermediate transfer belt 33.

How an image is formed by the image forming apparatus will be described below.

Each of four photosensitive element units 37 (37*a*, 37*b*, 37*c*, and 37*d*) includes a corresponding one of four developing units 34 (34*a*, 34*b*, 34*c*, and 34*d*), a corresponding one of photosensitive elements 35 (35*a*, 35*b*, 35*c*, and 35*d*), and a corresponding one of charging rollers 36 (36*a*, 36*b*, 36*c*, and 36*d*) that are combined together. The charging roller 36 comes into contact with the photosensitive element 35 and uniformly charges the surface of the photosensitive element 35. The surface of the photosensitive element 35 is scanned with a laser beam 39 for exposure in an exposure device 38. By this exposure, a latent image is formed on the surface of the photosensitive element 35. The latent image on the surface of the photosensitive element 35 is developed with toner into a toner image by the developing unit 34. The toner image is transferred from the surface of the photosensitive element 35 onto the surface of the intermediate transfer belt 33.

Subsequently, the toner image on the intermediate transfer belt 33 is then transferred onto the sheet 4 by the transfer drive roller 31 and the transfer driven roller 32. The sheet 4 is then conveyed to a fixing device 26 where the image is fixed onto the sheet 4 between a pair of fixing roller 40 and a heating roller 41. The sheet 4 is then discharged by the sheet discharge device 1 onto a sheet discharge tray (hereinafter, "tray") 3 to be stacked therein.

The sheet discharge device 1 will be described below with reference to FIGS. 2A and 2B.

Figure 2A:
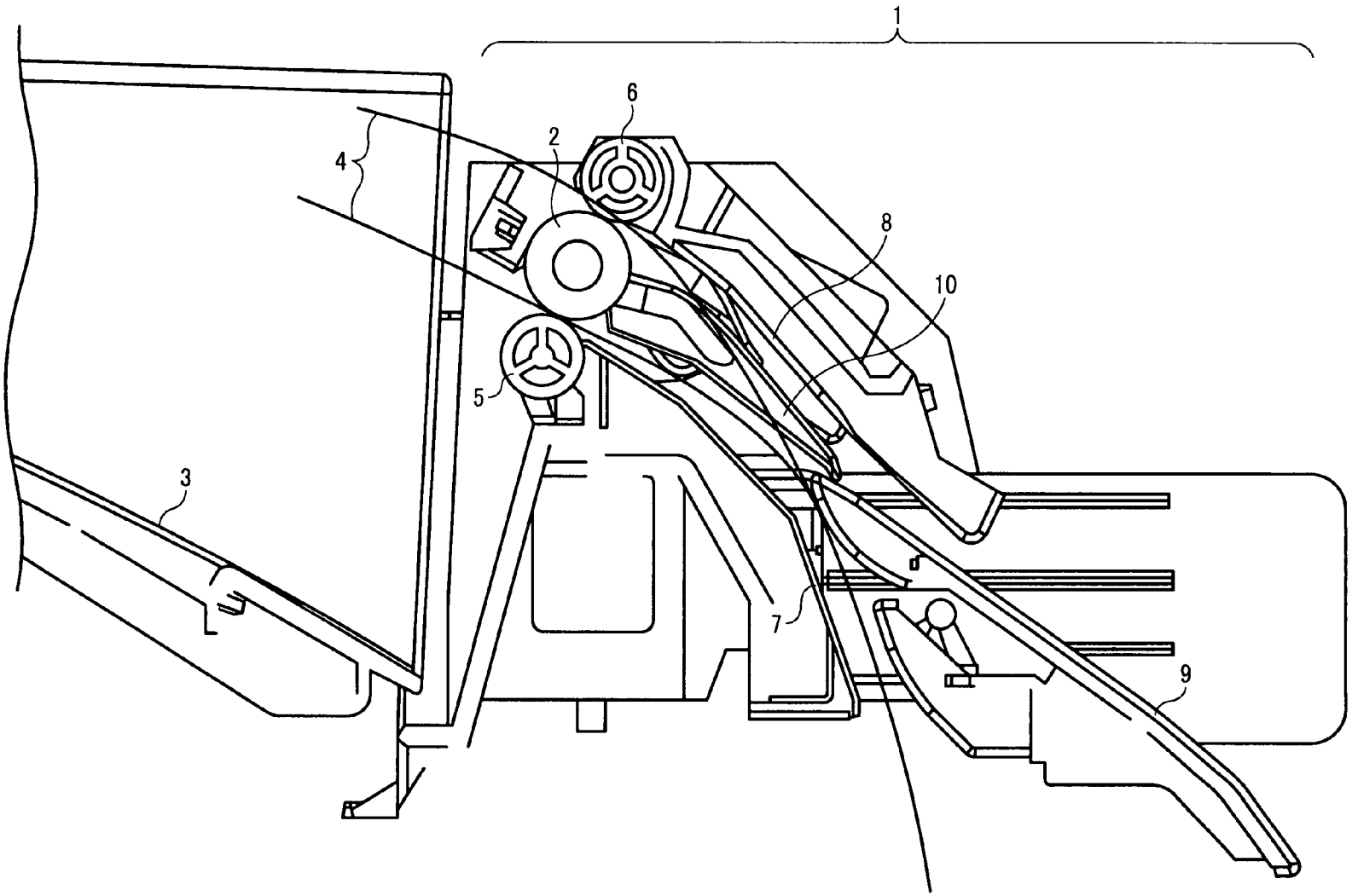
FIG. 2A is a schematic side view of the sheet discharge device depicted in FIG. 1.
Figure 2B:
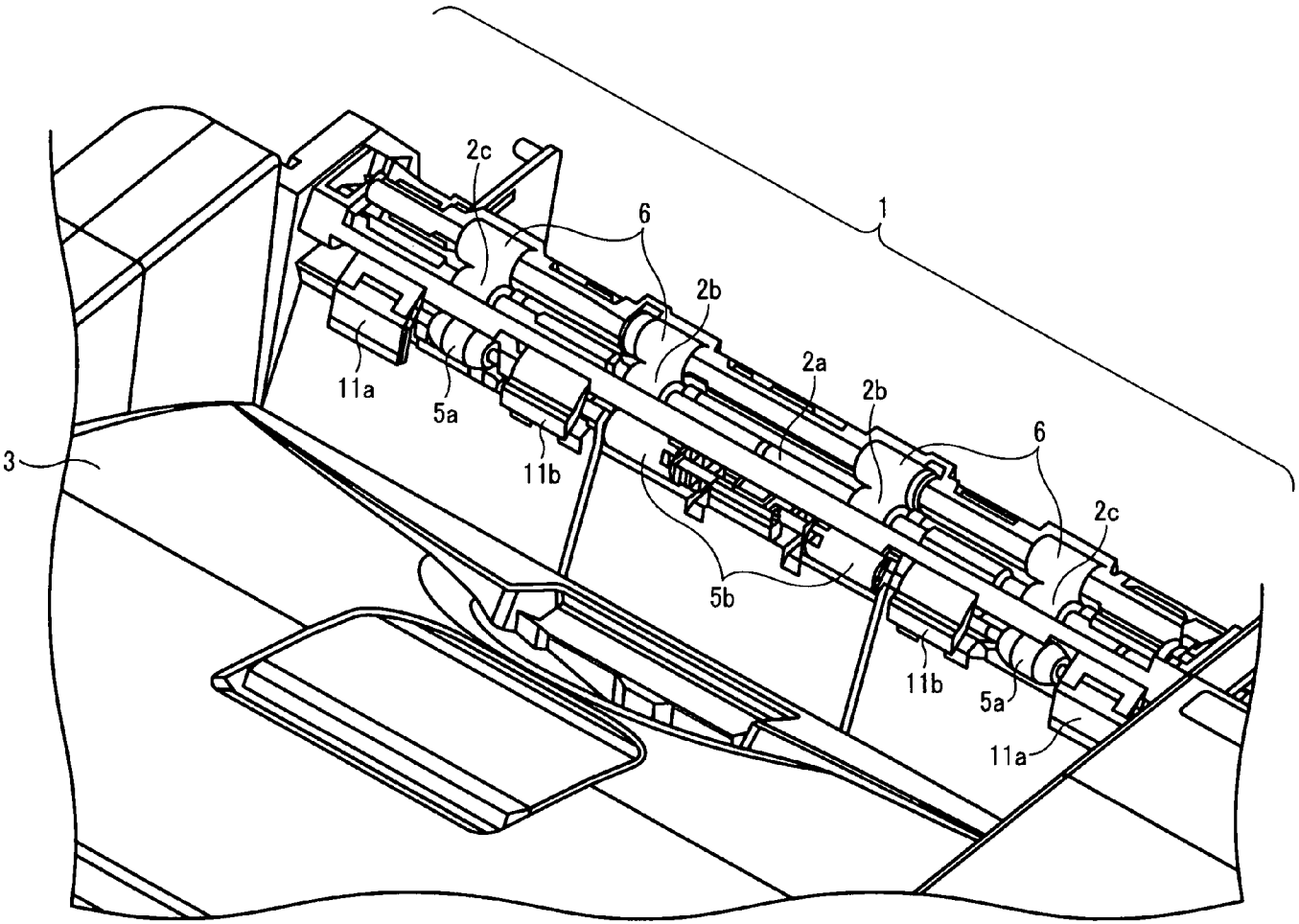
FIG. 2B is a schematic perspective view of the sheet discharge device depicted in FIG. 2A.

FIG. 2A is a schematic side view of the sheet discharge device 1. FIG. 2B is a schematic perspective view of the sheet discharge device 1. The sheet discharge device 1 includes a sheet-discharging drive roller group (hereinafter, "drive roller group") 2, a drive source (not shown), a sheet-discharging driven roller group (hereinafter, "driven roller group") 5, reverse driven rollers 6, a first guide 7, a second guide 8, a third guide 9, a switching guide 10, and a switching control mechanism (not shown). The drive roller group 2 includes inside sheet-discharging drive rollers (hereinafter, "inside drive rollers") 2*b* and outside sheet-discharging drive rollers (hereinafter, "outside drive rollers") 2*c*. The drive source drives the drive roller group 2. The driven roller group 5 includes inside sheet-discharging drive rollers (hereinafter, "inside driven rollers") 5*b* and outside sheet-discharging drive rollers (hereinafter, "outside driven rollers") 5*a*. The driven roller group 5 is rotated by the drive roller group 2 to discharge the sheet 4 to the tray 3. The reverse driven rollers 6 are rotated by the drive roller group 2 to reverse a traveling direction of the sheet 4. The first guide 7 guides the sheet 4 to a first nip between the drive roller group 2 and the driven roller group 5. The second guide 8 guides the sheet 4 to a second nip between the drive roller group 2 and the reverse driven rollers 6. The third guide 9 guides the sheet 4 of which traveling direction has been reversed by the reverse driven rollers 6 to a reverse conveying unit (not shown). The switching guide 10 switches a path of the sheet 4 between a path through the first nip and a path through the second nip. The switching control mechanism controls operation of the switching guide 10.

The inside drive rollers 2*b* and the outside drive rollers 2*c* are made of rubber whereby a sufficient frictional force to convey the sheet 4 is produced between the drive roller group 2 and the driven roller group 5 and between the drive roller group 2 and the reverse driven rollers 6 between which the sheet 4 is pinched and discharged.

Figure 3C:
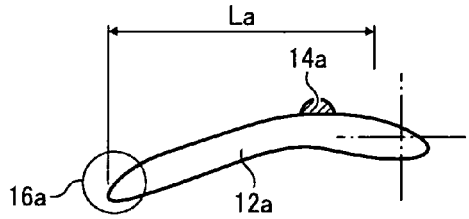
FIG. 3C is a schematic enlarged side view of the end retainer.
Figure 4A:
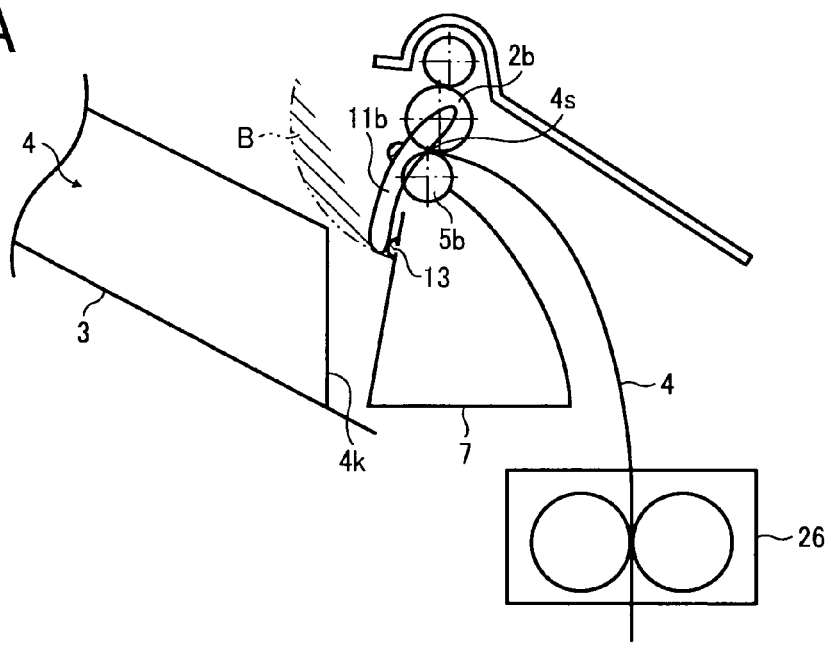
FIG. 4A is a schematic side view for explaining an inside retainer depicted in FIG. 2B in an unretracted orientation.
Figure 4B:
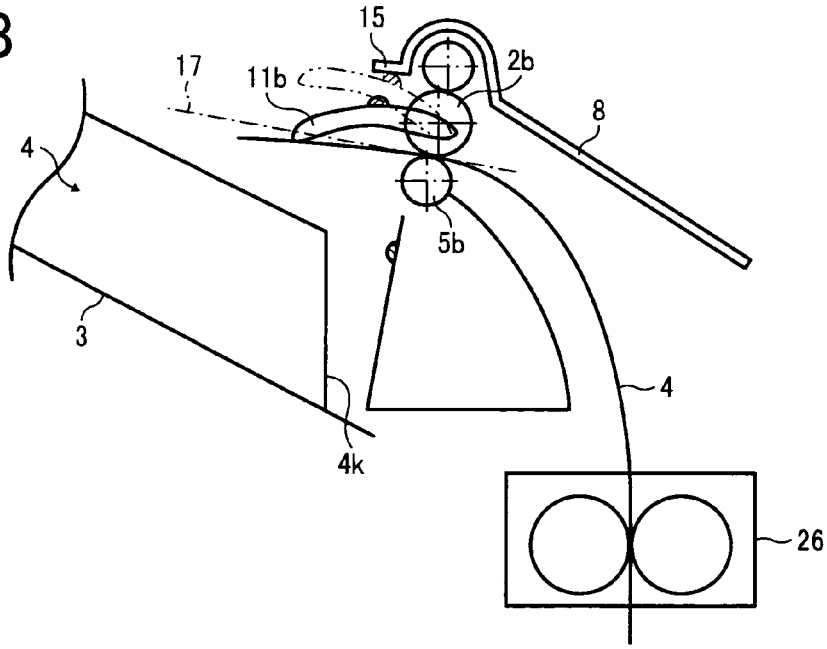
FIG. 4B is a schematic side view for explaining the inside retainer depicted in FIG. 4A in a most retracted orientation and in a retracted orientation.
Figure 4C:
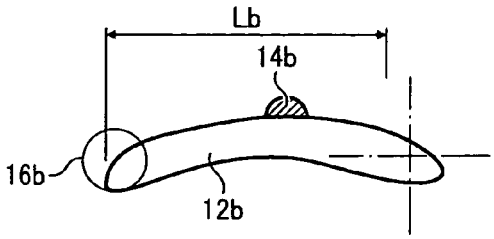
FIG. 4C is a schematic enlarged side view of the inside retainer.

End retainers 11*a* and inside retainers 11*b* are rotatably attached to a rotary shaft 2*a*. Although the end retainers 11*a* and the inside retainers 11*b* are rotatable about the rotary shaft 2*a*, they do not rotate together with the drive roller group 2. Each of the end retainers 11*a* includes a curved sheet guiding surface 12*a*, a positioning portion 14*a*, and a distal end 16*a* (see FIG. 3C). Each of the inside retainers 11*b* includes a sheet guiding surface 12*b*, a positioning portion 14*b*, and a distal end 16*b* (see FIG. 4C).

The end retainers 11*a* move when the sheet 4 is discharged to the tray 3. How the end retainers 11*a* move will be described with reference to FIGS. 3A to 3C.

The sheet 4 that exits the fixing device 26 is pinched and conveyed further by the drive roller group 2 and the outside driven rollers 5*a*. The pinched sheet 4 is conveyed until a leading edge 4*s* of the sheet 4 in the conveying direction comes into contact with the sheet guiding surface 12*a* of each of the end retainers 11*a* in any one of unretracted orientations. One of the unretracted orientations of the end retainer 11*a* is a downward orientation due to the pull of the gravity on the end retainer 11*a* in a state where the sheets 4 have not been stacked in the tray 3 to reach a pivoting range A of the end retainer 11*a* and the sheet guiding surface 12*a* abuts on a stopper 13 of the first guide 7 (see FIG. 3A). The other one of the unrectracted orientations is another downward orientation due to the pull of the gravity on the end retainer 11*a* in a state where a plurality of the sheets 4 have been discharged and stacked in the tray 3 to reach the pivoting range A and the distal end 16*a* of the end retainer 11*a* rests on the stack of the sheets 4 in the tray 3 (see FIG. 3A).

The end retainers 11*a* extend from the rotary shaft 2*a* across a common tangent of the drive roller group 2 and the driven roller group 5. Accordingly, the end retainers 11*a* come into contact with first near-side-end portions of the sheet 4 and exert a downward force on the first near-side-end portions by the pull of gravity on the end retainers 11*a*. Because the sheet 4 that receives the downward force is resiliently deformed, an amount of upward curl (hereinafter, "side curl") of the sheet 4 at the first near-side-end portions decreases. The end retainers 11*a* are constructed so as to rest on the stack in the tray 3. Accordingly, the end retainers 11*a* press the stack in the tray 3 at a portion near a trailing end 4*k* of the stack against the tray 3 to flatten the stack by the pull of gravity on the end retainers 11*a*. Meanwhile, when the sheet 4 has a maximum sheet width acceptable by the sheet discharge device 1 that is typically a frequently-used size, an amount of curl of the sheet 4 is likely to be large. The maximum sheet width is typically the A4 size, the letter size, or the legal size. Hence, it is preferable that the end retainers 11*a* are longer than the inside retainers 11*b* so that the sheet 4 of such a frequently-used size is resiliently deformed by a large amount to correct the large curl. In this manner, an increase in the height of the stack at the trailing end 4*k* in the tray 3 due to curling of the sheets 4 can be prevented. Accordingly, the stack is prevented from being pushed at the trailing end 4*k* by a trailing edge of a subsequently-discharged sheet. More specifically, when the sheets are discharged and stacked to reach a height limit, e.g., 20 millimeters in the tray 3, the distal end 16*a* of the end retainer 11*a* comes to rest on the trailing end 4*k* of the stack in the tray 3. When sheets are not stacked to reach this height limit, the end retainer 11*a* abuts on the stopper 13 of the first guide 7. In this example, the height limit is 20 millimeters; however, the height limit is not limited to this example.

The sheet 4 is conveyed further toward the tray 3. When the end retainer 11*a* is in a most retracted orientation, the distal end 16*a* of the end retainer 11*a* is on the side of the outside driven rollers 5*a* relative to a common tangent 17 of the drive roller group 2 and the outside driven rollers 5*a*, and apart from the common tangent 17 by a distance L1 (see FIG. 3B). Meanwhile, the sheet 4 would be discharged parallel to the common tangent 17 if the end retainers 11*a* and the inside retainers 11*b* were not provided. The positioning portion 14*a* of the end retainer 11*a* abuts on a retraction stopper 15 on the second guide 8 when the end retainer 11*a* is in the most retracted orientation. With this configuration, because the end retainer 11*a* is maintained in the most retracted orientation by an elastic force F exerted by the sheet 4 being discharged and, the sheet 4 is discharged onto the tray 3 while being curved to approach the tray 3. Meanwhile, the conveying direction, in which the sheet 4 is to be discharged onto the tray 3, has been set in advance to be within an exiting range (the pivoting area) A. By setting the exiting range in advance, the sheet is prevented from being excessively curved, thereby preventing the leading edge 4*s* of the sheet 4 from pushing the trailing end 4*k* of the stack in the tray 3.

Figure 3A:
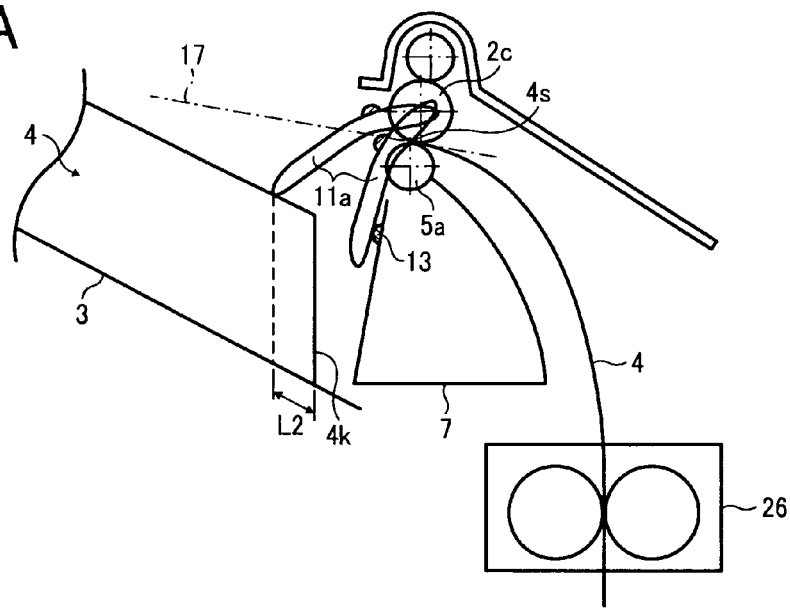
FIG. 3A is a schematic side view for explaining an end retainer depicted in FIG. 2B in unretracted orientations.
Figure 3B:
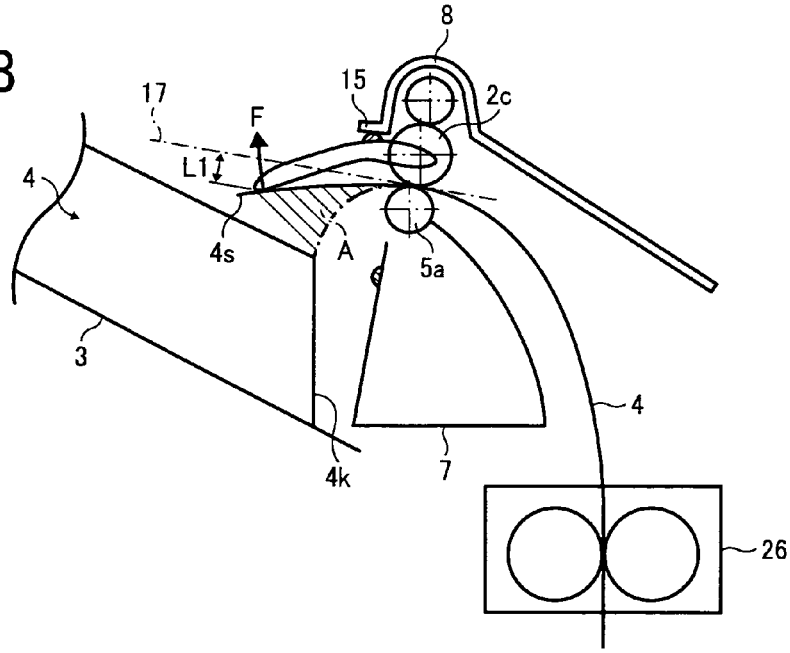
FIG. 3B is a schematic side view for explaining the end retainer depicted in FIG. 3A in a retracted orientation.

When a trailing edge of the sheet 4 exits the nip between the drive roller group 2 and the outside driven rollers 5*a*, the end retainer 11*a* returns to the unretracted orientation (FIG. 3A). At this time, the end retainer 11*a* presses the portion near the trailing end 4*k* of the stack in the tray 3 downward against the tray 3 or against the stack by the pull of gravity on the end retainer 11*a*. A length La of the end retainer 11*a* is set such that the distal end 16*a* is away from the trailing end 4*k* of the stack in the tray 3 by a distance L2. Hence, the distal end 16*a* of the end retainer 11*a* comes into contact with the topmost one sheet of the stack of the discharged sheets in the tray 3.

Figure 10:
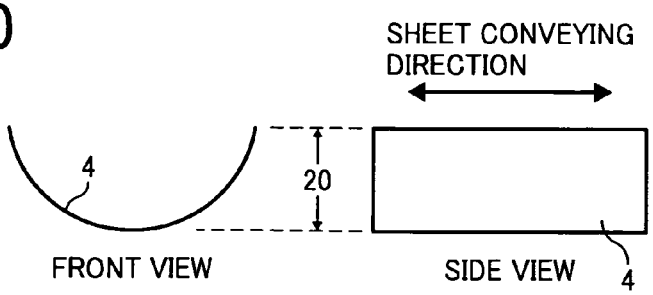
FIG. 10 is a view of a schematic front diagram and a side diagram of a sheet that has a side curl.

In this manner, the distal end 16*a* of the end retainer 11*a* comes into contact with the topmost sheet of the stack and retains the stack by pressing it downward. Accordingly, even when one or more of the sheets 4 of the stack in the tray 3 are curled upward as depicted in FIG. 10, an increase in the height of the stack at the trailing end 4*k* due to curling of a sheet is prevented, thereby reliably keeping the height of the stack to be below the common tangent 17. Hence, because the leading edge 4*s* of the sheet 4 does not push the portion near the trailing end 4*k* of the stack in the tray 3, the sheets 4 of the stack are prevented from being pushed out of the tray 3 or stacked improperly, e.g., in a disrupted order.

The inside retainers 11*b* move when the sheet 4 is discharged to the tray 3. How the inside retainers 11*b* move will be described with reference to FIGS. 4A to 4C.

As in the case of the end retainers 11*a*, the sheet 4 that exits the fixing device 26 is pinched and conveyed by the drive roller group 2 and the inside driven rollers 5*b*. The pinched sheet 4 is conveyed until the leading edge 4*s* of the sheet 4 comes into contact with the sheet guiding surface 12*b* of each of the inside retainers 11*b* in an unretracted orientation. In an unretracted orientation, the inside retainer 11*b* is downwardly orientated due to the pull of the gravity on the inside retainer 11*b*, and the sheet guiding surface 12*b* abuts on the stopper 13 of the first guide 7 (see FIG. 4A). A length Lb of the inside retainer 11*b* is set such that the trailing end 4*k* of the stack in the tray 3 is out of a pivoting range B of the inside retainer 11*b*.

As the sheet 4 is conveyed further toward the tray 3, the inside retainer 11*b* is pushed by the sheet 4 to pivot upward about the rotary shaft 2*a*. When the inside retainer 11*b* is in its most retracted orientation, the distal end 16*b* of the inside retainer 11*b* is on the side of the drive roller group 2 relative to the common tangent 17. In the most retracted orientation, the positioning portion 14*b* of the inside retainer 11*b* abuts on the retraction stopper 15 on the second guide 8. Hence, the inside retainer 11*b* is not brought into the most retracted orientation but into a retracted orientation in which the distal end 16*b* of the inside retainer 11*b* rests on the topmost one sheet of the stack in the tray 3 (see FIG. 4B).

The conveying direction of the sheet 4 is not changed by the inside retainer 11*b*. Hence, the sheet 4 is discharged in a direction close to the common tangent 17. Because the inside retainer 11*b* also extends from the rotary shaft 2*a* across the common tangent 17, the inside retainer 11*b* comes into contact with the sheet 4 that exits the nip between the drive roller group 2 and the inside driven rollers 5*b*. While contacting the sheet 4, the inside retainer 11*b* exerts a downward force on the sheet 4 by the pull of gravity on the inside retainer 11*b*. The downward force causes the sheet 4 to be resiliently deformed downward, thereby reducing an amount of a side curl of the sheet 4. At this time, the inside retainer 11*b* presses the stack of the sheets 4 in the tray 3 at the portion near the trailing end 4*k* downward against the tray 3 or against the stack by the pull of gravity on the inside retainer 11*b*.

Figure 5A:
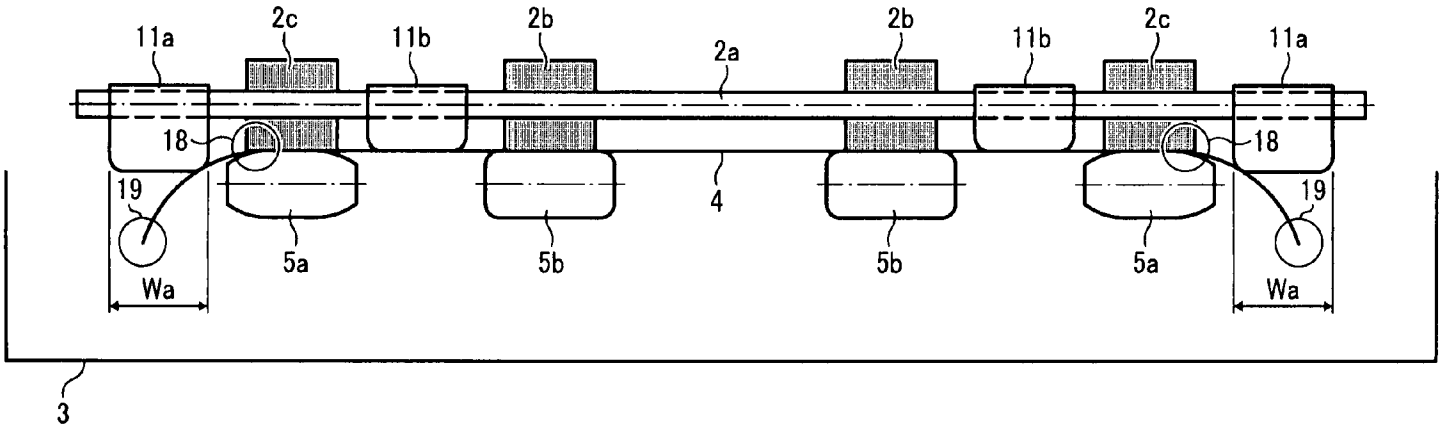
FIG. 5A is a schematic diagram for explaining how a sheet of a large width is discharged by the sheet discharge device depicted in FIG. 2B as viewed from a common tangent of the drive roller group and the driven roller group.

Because the end retainers 11*a* and the inside retainers 11*b* differ from each other in shape and pivoting range, the shape of the sheet 4 that is retained by at least ones of the end retainers 11*a* and the inside retainers 11*b* while being discharged varies accordingly. FIG. 5A is a schematic front view for explaining how the sheet 4 of a large width passes through the drive roller group 2 and the driven roller group 5 and FIG. 5B is a schematic front view for explaining how the sheet 4 of a small width passes through the drive roller group 2 and the driven roller group 5.

Figure 5B:
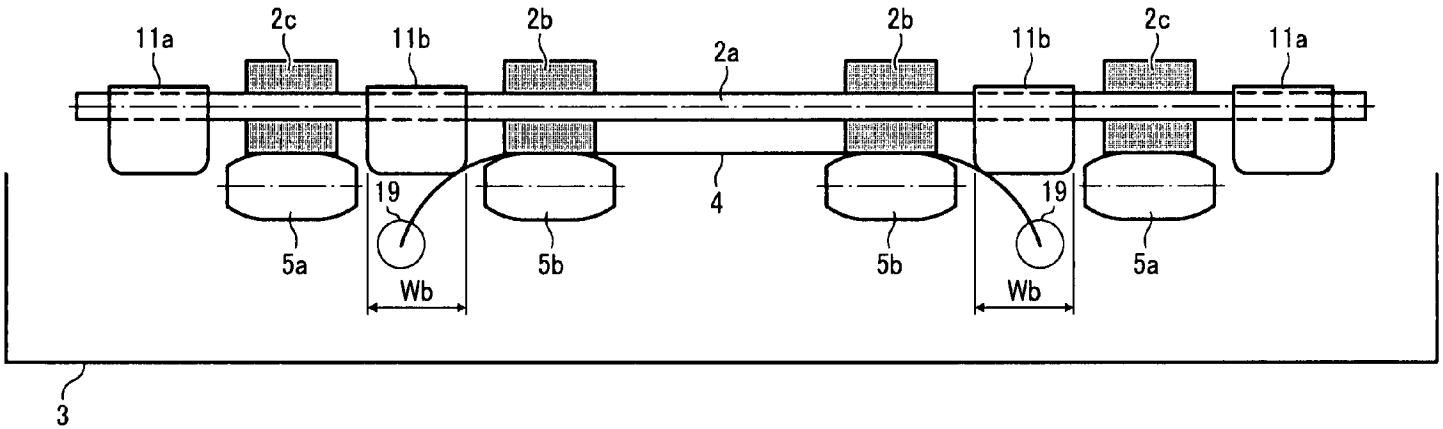
FIG. 5B is a schematic diagram for explaining how a sheet of a small width is discharged by a modification of the sheet discharge device depicted in FIG. 5A.

The sheet 4 is deformed at curved portions 18 to have a curve protruding toward the tray 3 such that lateral end portions 19 of the sheet 4 are closer to the tray 3 than the other portion of the sheet 4 (see FIGS. 5A and 5B). The curved portions 18 are near portions where the sheet 4 is pinched between the drive roller group 2 (the outside drive rollers 2*c* in FIG. 5A and the inside drive rollers 2*b* in FIG. 5B) and the outside driven rollers 5*a*. Because the sheet 4 is discharged to the tray 3 in the state of being resiliently deformed in this manner, it is possible to reduce a curl amount 20 of side curls of the sheet 4. A typical example of the curl is depicted in FIG. 10; however, a curl amount of various types of curl can be reduced by this simple configuration.

It is assumed that a maximum sheet width acceptable by the sheet discharge device 1 or the image forming apparatus that includes the sheet discharge device 1 is a width corresponding to the A4 size, and the letter size and the legal size. By individually positioning the lateral end portions 19 of the sheet 4 of such a frequently-used size within width ranges Wa of the end retainers 11*a*, the effect of retaining the stack in the tray 3 at the portion near the trailing end 4*k* and the effect of reducing an amount of side curls of the sheet 4 are favorably exerted on the sheet 4 of the frequently-used size.

These effects can also be favorably exerted on the sheet 4 of, e.g., the B5 size, of which width is smaller than the frequently-used size and accordingly likely to have a small curl, by individually positioning the lateral end portions 19 of the sheet 4 within width ranges Wb of the inside retainers 11*b*.

FIGS. 6A to 8C are schematic diagrams for explaining the sheet discharge device 1 according to a second embodiment of the present invention.

Figure 6A:
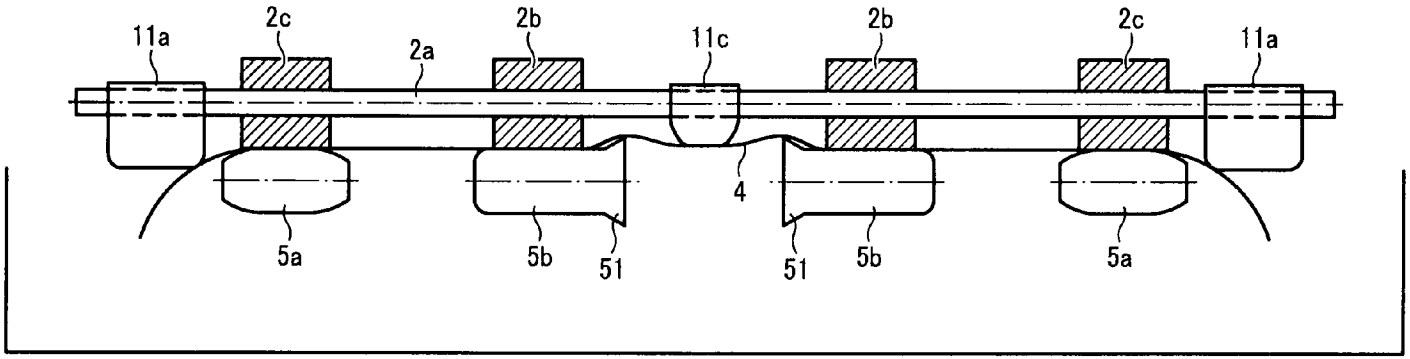
FIG. 6A is a schematic diagram for explaining how a sheet of a large width is discharged by a sheet discharge device according to a second embodiment of the present invention.

FIG. 6A is a schematic diagram for explaining how a sheet of a large width is discharged by the sheet discharge device 1 according to the second embodiment. As in the first embodiment, the drive roller group 2 includes the two inside drive rollers 2*b* and the two outside drive rollers 2*c* arranged to be symmetric about a sheet conveyance center, which serves as a reference in conveyance of the sheet 4. The outside driven rollers 5*a* abut on the outside drive rollers 2*c* while the inside driven rollers 5*b* abut on the inside drive rollers 2*b*. Because each of the inside drive rollers 2*b* and the outside drive rollers 2*c* is made of rubber, a sufficient frictional force to convey the sheet 4 is provided between the drive roller group 2 and the driven roller group 5 that convey the sheet 4 by pinching the sheet 4 therebetween. The end retainers 11*a* and the inside retainers 11*b* are attached to the rotary shaft 2*a* to be rotatable about the rotary shaft 2*a* but not to rotate together with the drive roller group 2.

In the second embodiment, each of the inside driven rollers 5*b* includes an expanded portion 51 and a nip portion where the inside driven roller 5*b* abuts on the inside drive roller 2*b*. The expanded portion 51 is arranged to be closer to the sheet conveyance center in a first direction, which is sheet width direction and parallel to the axis of the rotary shaft 2*a*, than the nip portion is. The diameter of the expanded portion 51 is larger than the diameter of the nip portion. The rotary shaft 2*a* has the two end retainers 11*a* and a center retainer 11*c*. The center retainer 11*c* is arranged at the sheet conveyance center between the inside drive rollers 2*b*. The end retainers 11*a* are arranged further away from the sheet conveyance center in the first direction than the outside drive rollers 2*c* are. The center retainer 11*c* includes a sheet guiding surface 12*c*, a positioning portion 14*c*, and a distal end 16*c* (see FIG. 8C).

When the rotary shaft 2*a* additionally includes the expanded portion 51, the sheet 4 receives an upward force from the expanded portion 51 as well as a downward force from the center retainer 11*c*. As a result, the sheet 4 is resiliently deformed at its center. Because the sheet 4 is resiliently deformed in this manner, the sheet 4 exits the first nip between the drive roller group 2 and the driven roller group 5 in a state of jutting frontward by a relatively large distance rather than being curved downward immediately after exiting the first nip by the pull of gravity on the sheet 4. Because the sheet 4 is resiliently deformed by a sufficient amount in this manner even when the sheet 4 has a large curl, the stack in the tray 3 is not pushed by the sheet 4. Hence, pushing one or more sheets of the stack out of the tray 3 or disrupting the order of the sheets in the tray 3 is prevented.

Figure 7:
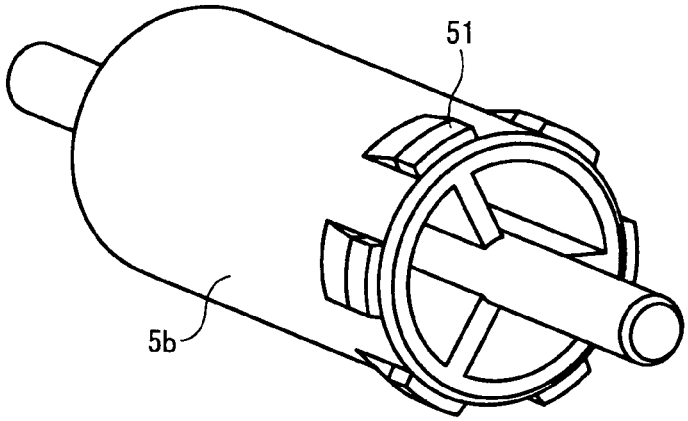
FIG. 7 is a schematic perspective view of a modification of an expanded portion of an inside driven roller.

A modification of the expanded portion 51 is depicted in FIG. 7. The expanded portion 51 according to this modification includes an uneven circumferential surface that includes protruding portions and recessed portions arranged alternately. The diameter of the inside driven roller 5*b* at the protruding portions is the same as that at the expanded portion 51, and the diameter at the recessed portions is the same as that at the nip portion. When the expanded portion 51 is constructed in this manner, the sheet 4 is caught at its trailing end portion by the protruding portion of the expanded portion 51 and discharged without fail. Because the sheet 4 is resiliently deformed more reliably, the effects of preventing sheets of the stack from being pushed out of the tray 3 or disrupted in the order of the sheets in the tray 3 are enhanced.

Figure 6B:
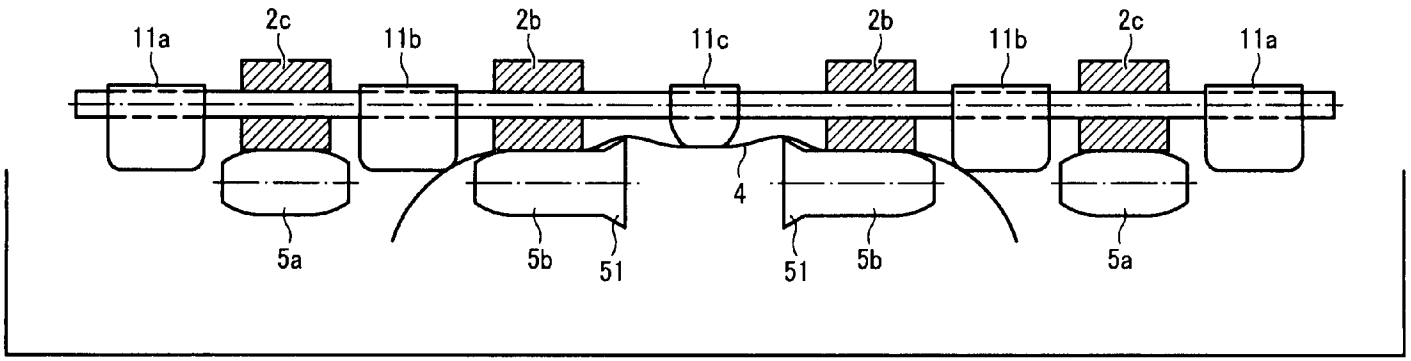
FIG. 6B is a schematic diagram for explaining how a sheet of a small width is discharged by a modification of the sheet discharge device according to the second embodiment.

FIG. 6B is a schematic diagram for explaining a modification of the second embodiment. In contrast to FIG. 6A, FIG. 6B depicts a state in which a sheet of a small width is discharged. The configuration depicted in FIG. 6B differs from that depicted in FIG. 6A in additionally including the two inside retainers 11*b* that are arranged individually between the end retainers 11*a* and the center retainer 11*c*. The inside driven roller 5*b* is tapered toward its outside end on a side away from the sheet conveyance center in the first direction. By virtue of this structure, a contact area along the rotary shaft 2*a* between the inside driven rollers 5*b* and the inside drive rollers 2*b* is smaller than a contact area between the drive roller group 2 and the rotary shaft 2*a*, which will be described later in detail. When the sheet 4 of a small width is discharged through the first nip, the sheet 4 is curved at two near-side-end portions by the inside retainers 11*b* as depicted in FIG. 6B. With this configuration, an area where the sheet 4 receives a force from the inside retainers 11*b* is wider than that with the configuration depicted in FIG. 6A. Hence, the image surface of the sheet 4 is reliably protected from being damaged while the sheet 4 is discharged. This configuration is further advantageous in that the sheet 4 is less likely to be bent sharp because the sheet 4 is discharged on a smooth curved surface of the inside driven rollers 5*b* that are tapered toward the outside ends. Hence, the image surface is more reliably protected from being damaged.

Figure 8A:
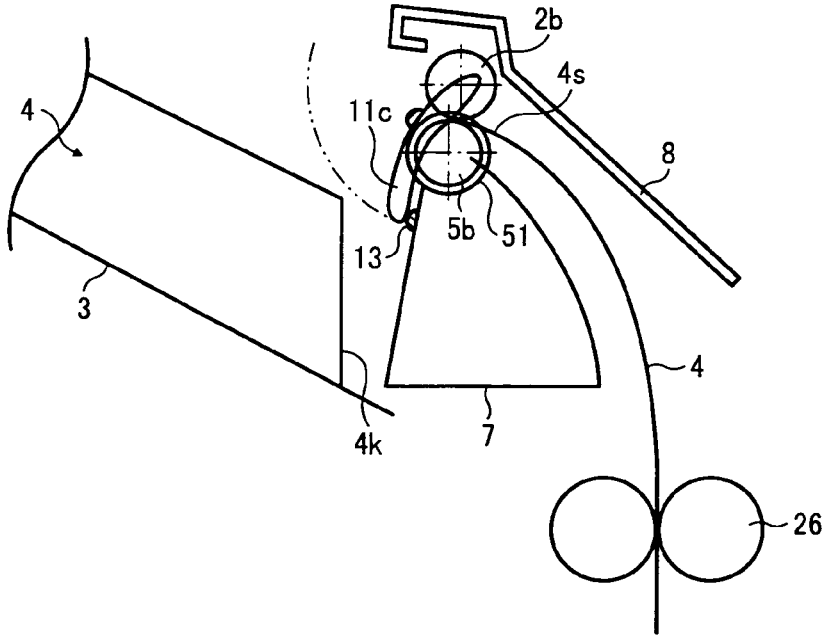
FIGS. 8A and 8B are schematic projection views taken orthogonal to an axial direction of a rotary shaft for explaining how a center retainer depicted in FIG. 6B moves when a sheet is discharged.
Figure 8B:
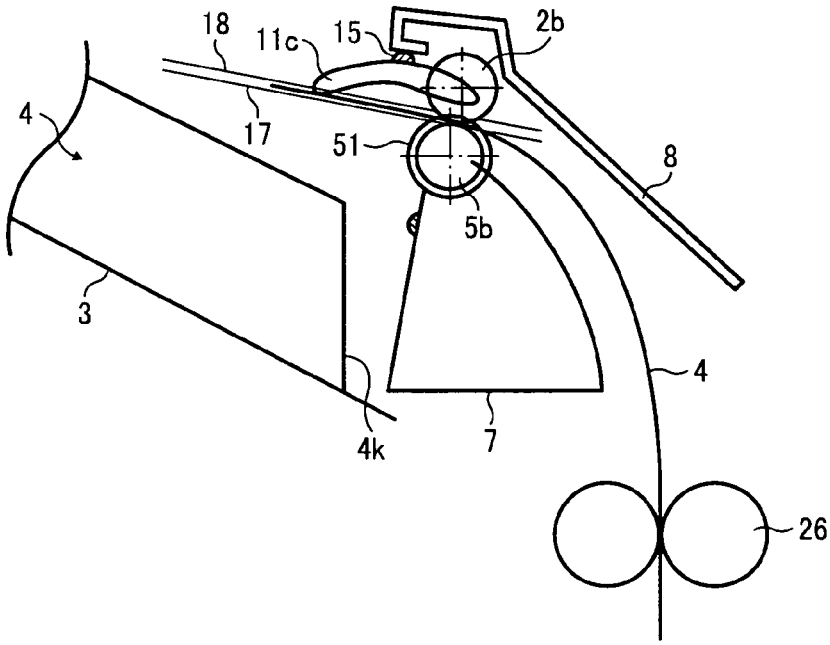
Figure 8C:
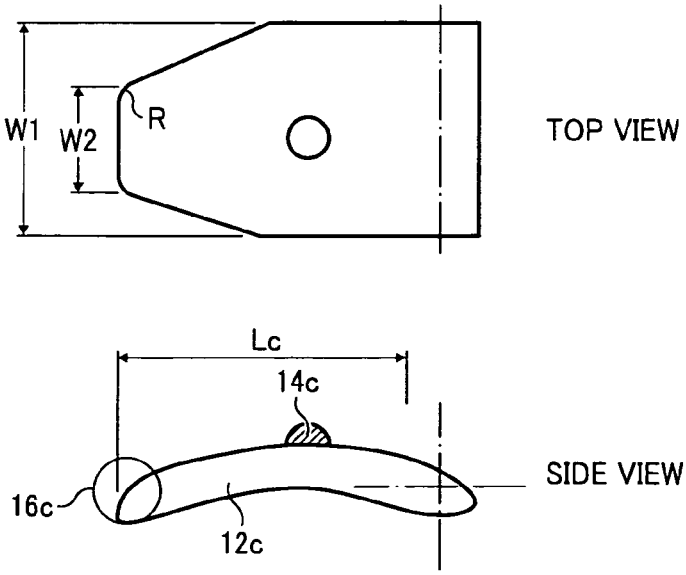
FIG. 8C is a view of schematic diagrams of the center retainer depicted in FIGS. 8A and 8B.

FIGS. 8A and 8B are schematic projection views taken orthogonal to the first direction (axial direction of the rotary shaft 2*a*) for explaining how the center retainer 11*c* moves when the sheet 4 is discharged to the tray 3. The end retainers 11*a* and the inside retainers 11*b* are identical to those depicted in FIGS. 3A to 4C, repeated descriptions thereof are omitted.

The sheet 4 that exits the fixing device 26 is pinched and conveyed by the drive roller group 2 and the outside driven rollers 5*a*. The pinched sheet 4 is conveyed until the leading edge 4*s* of the sheet 4 comes into contact with the sheet guiding surface 12*c* of the center retainer 11*c* in an unretracted orientation. In the unretracted orientation, the center retainer 11*c* is downwardly orientated due to the pull of the gravity on the center retainer 11*c* and the sheet guiding surface 12*c* abuts on the stopper 13 of the first guide 7 (see FIG. 8A). A length Lc of the center retainer 11*c* is set such that the trailing end 4*k* of the stack in the tray 3 is out of a pivoting range of the center retainer 11*c*.

As the sheet 4 is conveyed further toward the tray 3, the center retainer 11*c* is pushed by the sheet 4 being discharged to pivot upward about the rotary shaft 2*a*. When the center retainer 11*c* is in a most retracted orientation, the distal end 16*c* of the center retainer 11*c* is on the side of the drive roller group 2 relative to the common tangent 17, and between the common tangent 17 and a tangent line 18, which extends parallel to the common tangent 17, of the expanded portion 51 (FIG. 8B). In the most retracted orientation, the positioning portion 14*c* of the center retainer 11*c* abuts on the retraction stopper 15 on the second guide 8. Hence, the center retainer 11*c* is not brought into the most retracted orientation but into a retracted orientation in which the distal end 16*c* of the center retainer 11*c* rests on the topmost one sheet of the stack in the tray 3. The sheet 4 being discharged is likely to be upwardly deformed at the center portion by the expanded portion 51 between the inside driven rollers 5*b*. However, the center retainer 11*c* restricts an amount of this upward deformation. Hence, because the sheet 4 is resiliently deformed by the expanded portion 51 and the center retainer 11*c*, it is possible to set a position where the sheet 4 reaches the top of the stack in the tray 3 away from the first nip. This prevents sheets from being pushed out of the tray 3 or prevents the order of the sheets in the tray 3 from being disrupted.

With this configuration, the center retainer 11*c* presses the sheet 4 downward such that a pressed portion of the sheet 4 is below an upper most portion of the expanded portion 51. When the inside driven rollers 5*b* as depicted in FIG. 7 is used, a trailing end portion of the sheet 4 is caught by the uneven surface of the expanded portion 51 and conveyed to exit the first nip without fail. After the trailing edge of the sheet 4 has exited the first nip, the center retainer 11*c* pushes down the sheet 4 by the pull of gravity on the center retainer 11*c* against the tray 3 or against the stack in the tray 3. Because the sheet 4 is pushed down in this manner, the trailing edge will not remain near the first nip. This prevents a subsequent sheet from entering into beneath one or more sheets of the stack or disrupting the order of the sheets of the stack.

When the end retainers 11*a* and the center retainer 11*c* are constructed in this manner to have different shapes and move within the different pivoting ranges, the sheet 4 being discharged is deformed as depicted in FIG. 6A or 6B. Each of FIGS. 6A and 6B is a schematic diagram for explaining how the sheet 4 is deformed as viewed from the common tangent 17.

An image forming apparatus according to an aspect of the present invention is formed as follows. When a maximum sheet width acceptable by the image forming apparatus is a width of a frequently-used sheet size such as the A4 size, the letter size, or the legal size, two lateral ends in the first direction of a sheet of such a frequently-used size are set to fall within width ranges of the end retainers 11*a*. Accordingly, the effects provided by the end retainers 11*a* of retaining the stack of the sheets 4 in the tray 3 at the portion near the trailing end 4*k* and reducing the amount of curl of the sheets are exerted on frequently-used sheets.

The expanded portions 51 of the inside driven rollers 5*b* that come into press contact with the inside drive rollers 2*b* are arranged on the side of the sheet conveyance center relative to the inside drive rollers 2*b*. Accordingly, the effect of pinching the sheet 4 between the inside drive rollers 2*b* and the inside driven rollers 5*b* and the effect provided by the expanded portions 51 and the center retainer 11*c* of resiliently deforming the sheet 4 to prevent the sheet 4 from remaining near the first nip are exerted not only on the sheet 4 of the maximum sheet width but also on the sheet 4 of a minimum sheet width. Hence, it is possible to exert these effects on a sheet of an arbitrary size acceptable by the sheet discharge device 1.

By modifying the center retainer 11*c* and the expanded portion 51 as will be described below, the effect of resiliently deforming the sheet 4 by using the expanded portion 51 and the center retainer 11*c* can also be provided while preventing a possible damage such as wrinkling of the sheet 4. According to this modification, both the expanded portion 51 and the distal end 16*c* of the center retainer 11*c* are tapered. The distal end 16*c* is tapered such that a width W1 of the center retainer 11*c* gradually decreases to a width W2, which is the width at its distal end. The distal end at which the center retainer 11*c* comes into contact with the stack in the tray 3 to retain the stack can have two corners of obtuse angles on a leading edge. The corners can alternatively be curved (see FIG. 8C). A position of the distal end of the center retainer 11*c* in the maximum retracted orientation is restricted to be on the side of the drive roller group 2 relative to the common tangent 17. By this restriction, a magnitude of the force exerted from the center retainer 11*c* on the stack to retain the stack is restricted. Because an amount of stress applied to the sheet 4 by the center retainer 11*c* is eased in this manner, the sheet 4 is prevented from receiving an unnecessarily large stress.

Figure 9A:
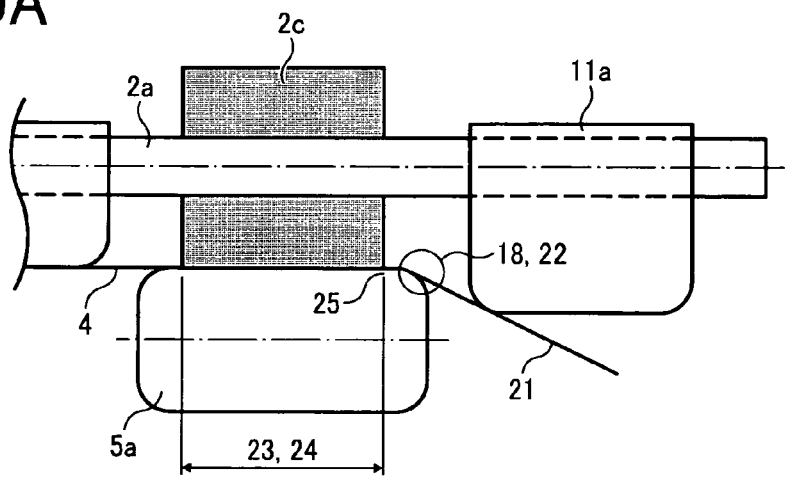
FIGS. 9A and 9B are schematic diagrams for explaining the shape of the driven roller depicted in FIG. 5A.

The shape of the outside driven rollers 5*a* will be described with reference to FIGS. 9A and 9B.

Figure 9B:
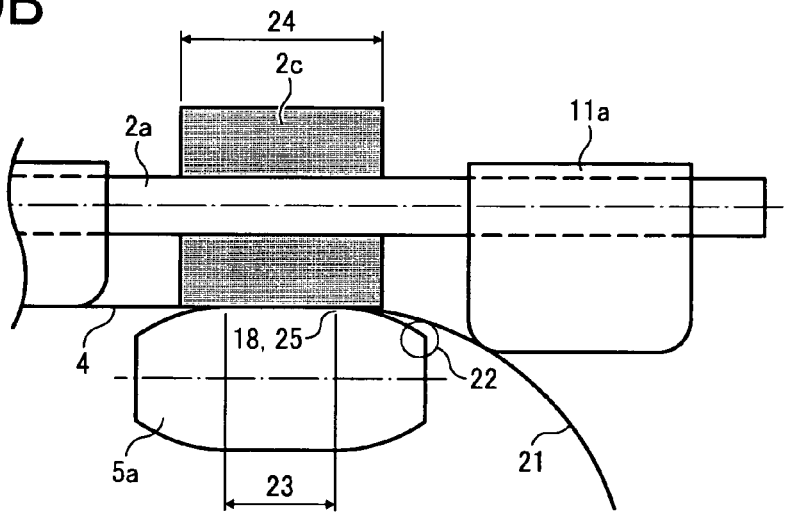

FIG. 9B is a schematic enlarged view of the outside driven roller 5*a* and the end retainers 11*a* depicted in FIG. 5A. Because the sheet 4 is deformed at curved portions 18 near which the sheet 4 is pinched between the outside drive rollers 2*c* and the outside driven rollers 5*a*, the sheet 4 receives a strongest force at portions corresponding to roller ends 22 of the outside driven rollers 5*a* on an image surface side 21. When the sheet 4 has side curls as depicted in FIG. 10, the force received by the sheet 4 is likely to be particularly large. This can result in damages on the image on the sheet 4.

To this end, the outside driven roller 5*a* of this modification is constructed so as to receive the force at wider areas. More specifically, a width of a contact area 23 where the outside driven roller 5*a* contacts the outside drive roller 2*c* is smaller in the first direction than a width 24 of the outside drive roller 2*c*, and the outside driven roller 5*a* is tapered from a contact-end point 25 of the contact area 23 toward the roller end 22. Because the roller end 22 and the curved portion 18 are arranged so as not to overlap on each other in this manner, the sheet 4 receives a force from the outside driven rollers 5*a* at a wider area as compared to that in the configuration depicted in FIG. 9A. Hence, the image surface of the sheet 4 is reliably protected from being damaged while the sheet 4 is discharged. This configuration is also advantageous in that the sheet 4 is less likely to be bent sharp because the sheet 4 is guided with the image surface side 21 facing the smooth curved surface at the roller ends 22 of the tapered outside driven rollers 5*a*. Accordingly, the image surface is more reliably protected from being damaged.

The inside driven rollers 5*b* depicted in FIG. 5B or 6B can be constructed in a similar manner to that described above. More specifically, a width of a contact area where the inside driven roller 5*b* contacts the inside drive roller 2*b* is smaller in the first direction than a width of the inside drive roller 2*b*, and the inside driven roller 5*b* is tapered from a contact-end point of the contact area toward a roller end of the inside driven roller 5*b*. Because the roller end and a curved portion are arranged so as not to overlap on each other in this manner, the sheet 4 receives a force from the inside driven rollers 5*b* at a wider area. Hence, the image surface of the sheet 4 is reliably protected from being damaged while the sheet 4 is discharged.

In this manner, the sheet discharge device 1 includes at least two types of the retainers on the rotary shaft of the drive roller group. The retainers are shaped so as not to damage an image surface of a sheet being discharged. The sheet discharge device that has a simple structure can stack discharged sheets more favorably, thereby ensuring high-quality images. The image forming apparatus that includes the sheet discharge device is, accordingly, capable of forming high-quality images.

According to an aspect of the present invention, pushing a sheet out of the tray or disruption in the order of sheets in the tray is prevented with a simple structure without using a larger sheet discharge tray or an additional movable guide that requires a drive source. Hence, not only it is possible to construct an image forming apparatus capable of forming high-quality images but also it is possible to construct the image forming apparatus compact and less expensively.

According to the technique disclosed in Japanese Patent Application Laid-open No. 2001-270642, because sheet retainers that retain a sheet being discharged at near-side-end portions of the sheet have large lengths, the sheet can be bent while the sheet is discharged. In contrast, a sheet discharge device according to another aspect of the invention includes, in addition to end retainers, inside retainers. The end retainers resiliently deform a sheet to reduce an amount of curl of the sheet. Furthermore, because the end retainers come into contact with the sheet from above, a leading edge of the sheet being discharged is less likely to push a stack of discharged sheets. Accordingly, pushing the sheets of the stack out of the tray is prevented. The inside retainers prevent lateral end portions of the sheet from entering inside the end retainers to be undesirably bent. In addition, because the inside retainers press the sheet at its trailing end portion against the tray in cooperation with the end retainers, the sheet discharge device can exert the same effect on a sheet that has a large width and is accordingly heavy such as the A4-size sheet or the letter-size sheet as that exerted on a small-width sheet.

According to still another aspect of the present invention, the sheet is resiliently deformed in a first direction that is an axial direction of the rotary shaft with a simple structure without fail.

According to still another aspect of the present invention, an image forming apparatus that is highly reliable can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet discharge device that discharges a sheet of a recording medium on which an image has been formed to a sheet discharge tray, the sheet discharge device comprising:

a rotary shaft that extends in a first direction and has a sheet conveyance center in the first direction;

a drive roller group that includes at least two inside drive rollers rotatably arranged on the rotary shaft on either sides of the sheet conveyance center and at least two outside drive rollers rotatably arranged on the rotary shaft on either sides of the inside drive rollers;

a driven roller group that includes at least two inside driven rollers and at least two outside driven rollers, the inside driven rollers individually opposing the inside drive rollers to be rotated by the inside drive rollers, the outside driven rollers individually opposing the outside drive rollers to be rotated by the outside drive rollers;

at least two end retainers each of which is rotatably attached to the rotary shaft and positioned adjacent to one of the outside drive rollers from a side away from the sheet conveyance center, the end retainers coming into press contact with first near-side-end portions of the sheet being discharged to retain the sheet; and at least two inside retainers each of which is rotatably attached to the rotary shaft and adjacent to one of the inside drive rollers from a side away from the sheet conveyance center, the inside retainers coming into press contact with second near-side-end portions of the sheet being discharged to retain the sheet, each retainer of the end retainers and the inside retainers including a distal end on a side away from the rotary shaft, wherein when the each retainer is in an unretracted orientation, the each retainer extends from the rotary shaft such that the distal end is further away from the rotary shaft than a common tangent of the drive roller group and the driven roller group is, and the end retainers are longer than the inside retainers.

2. The sheet discharge device according to claim 1, wherein the each retainer is lifted up from the unretracted orientation by a force that the each retainer receives from the sheet being discharged, and is returned to the unretracted orientation by a pull of gravity on the each retainer.

3. The sheet discharge device according to claim 2, wherein the at least two end retainers are substantially identical in shape to each other, when the end retainers are in a most retracted orientation, the distal end of each of the end retainers is positioned on a side of the driven roller group relative to the common tangent, and the end retainer is brought into constant contact with a retraction stopper by a force that the end retainer receives from the sheet being discharged.

4. The sheet discharge device according to claim 2, wherein the at least two inside retainers are substantially identical in shape to each other, when the inside retainers are in a most retracted orientation, the distal end of each of the inside retainers is positioned on a side of the drive roller group relative to the common tangent, and a retracted orientation of the inside retainer depends on a position of the sheet being discharged.

5. The sheet discharge device according to claim 3, wherein each of the end retainers has a curved surface that faces the sheet being discharged, while the sheet is discharged to the sheet discharge tray, a leading edge of the sheet advances along the curved surface through an area, the area being on the side of the driven roller group relative to the common tangent and set such that the leading edge of the sheet that has been discharged through the area does not push a trailing end of a stack of sheets in the discharge tray.

6. The sheet discharge device according to claim 3, wherein when a sheet to be discharged has a maximum sheet width acceptable by the sheet discharge device, two edges of the sheet in the first direction individually fall within width ranges of two of the at least two end retainers.

7. The sheet discharge device according to claim 4, wherein when a sheet to be discharged has a maximum sheet width acceptable by the sheet discharge device, two edges of the sheet in the first direction individually fall within width ranges of two of the at least two inside retainers.

8. The sheet discharge device according to claim 3, wherein each driven roller of the inside driven rollers and the end driven rollers is in contact with the sheet at a first contact area, a diameter of the each driven roller gradually decreases from an outside end of the first contact area to an outside end of the driven roller, the outside being a side away from the center of the rotary shaft, and a curved portion of the sheet pinched between the drive roller group and the driven roller group does not overlap the outside end of the driven roller so that the first contact area is smaller than a second contact area between a corresponding one of the drive rollers and the sheet.

9. An image forming apparatus comprising:

a conveying unit that feeds and conveys a sheet of a recording medium;

a transfer unit that transfers an image onto the sheet;

a fixing unit that applies heat and pressure to the sheet to fix the transferred image onto the sheet; and the sheet discharge device according to claim 1.

10. A sheet discharge device that discharges a sheet of a recording medium on which an image has been formed to a sheet discharge tray, the sheet discharge device comprising:

a rotary shaft that extends in a first direction and has a sheet conveyance center in the first direction;

a drive roller group that includes at least two inside drive rollers rotatably arranged on the rotary shaft on either sides of the sheet conveyance center and at least two outside drive rollers rotatably arranged on the rotary shaft;

a driven roller group that includes at least two inside driven rollers and at least two outside driven rollers, the inside driven rollers individually opposing the inside drive rollers to be rotated by the inside drive rollers, the outside driven rollers individually opposing the outside drive rollers to be rotated by the outside drive rollers;

at least two end retainers each of which is rotatably attached to the rotary shaft and positioned adjacent to one of the outside drive rollers from a side away from the sheet conveyance center, the end retainers coming into press contact with first near-side-end portions of the sheet being discharged to retain the sheet;

at least two inside retainers each of which is rotatably attached to the rotary shaft and adjacent to one of the inside drive rollers from a side away from the sheet conveyance center, the inside retainers coming into press contact with second near-side-end portions of the sheet being discharged to retain the sheet; and at least one center retainer that is rotatably arranged on the rotary shaft and positioned between the inside drive rollers, the center retainer coming into press contact with a center portion of the sheet being discharged to retain the sheet, each retainer of the end retainers and the center retainer including a distal end on a side away from the rotary shaft, wherein when the each retainer is in an unretracted orientation, the each retainer extends from the rotary shaft such that the distal end is further away from the rotary shaft than a common tangent of the drive roller group and the driven roller group is, each of the inside driven rollers includes a nip portion where the inside driven roller contacts the inside drive roller and an inside portion where the inside driven roller does not contact the inside drive roller, the inside driven roller includes, on the inside portion, an expanded portion at which a diameter of the inside driven roller is larger than at the nip portion, and the end retainers are longer than the center retainer.

11. The sheet discharge device according to claim 10, wherein the each retainer is supported such that the each retainer is moved from an unretracted orientation to a retracted orientation by the sheet being discharged and returns to the unretracted orientation after the sheet has been discharged, the each retainer in the unretracted orientation being oriented such that the distal end is below the common tangent in a projection view taken orthogonal to the first direction, and the distal end in the retracted orientation is restricted to fall within a range above the common tangent and below a tangent of the expanded portion.

12. The sheet discharge device according to claim 10, wherein the each retainer is supported such that the each retainer is moved from an unretracted orientation to a retracted orientation by the sheet being discharged and returns to the unretracted orientation after the sheet has been discharged, the each retainer in the unretracted orientation being oriented such that the distal end is below the common tangent in a projection view taken orthogonal to the first direction, and the distal end in the retracted orientation is restricted to fall within a range above the common tangent and below a tangent of the expanded portion, the tangent extending parallel to the common tangent and being above the common tangent.

13. The sheet discharge device according to claim 10, wherein the expanded portion is positioned within a width range of a sheet that has a minimum sheet width acceptable by the sheet discharge device in the first direction.

14. The sheet discharge device according to claim 10, wherein the distal end of the center retainer is tapered and has at least one obtuse angle on a leading edge of the distal end.

15. The sheet discharge device according to claim 10, wherein the expanded portion has an uneven circumferential surface.

16. An image forming apparatus comprising:

a conveying unit that feeds and conveys a sheet of a recording medium;

a transfer unit that transfers an image onto the sheet;

a fixing unit that applies heat and pressure to the sheet to fix the transferred image onto the sheet; and the sheet discharge device according to claim 10.

17. The sheet discharge device of claim 1, wherein the at least two end retainers and the at least two inside retainers are positioned to come into contact with the sheet being discharged, the contact downstream from a nip between the drive roller group and the driven roller group in a discharge direction of the sheet, and the at least two end retainers and the at least two inside retainers are configured to downwardly deform at least one edge of the sheet being discharged.

18. The sheet discharge device of claim 10, wherein the at least two end retainers and the at least two inside retainers are positioned to come into contact with the sheet being discharged, the contact downstream from a nip between the drive roller group and the driven roller group in a discharge direction of the sheet, the at least two end retainers are configured to downwardly deform at least one edge of the sheet being discharged, and the at least one center retainer is configured to deform an upward deformation of the sheet being discharged by downwardly deforming the sheet being discharged using an expanded portion of the at least one center retainer.

* * * * *